US005494165A

United States Patent [19]

Detrick

[11] Patent Number: 5,494,165

[45] Date of Patent: Feb. 27, 1996

[54] CONTAINER FOR HOLDING ARTICLES TO BE VACUUMED PACKED

[76] Inventor: Robert P. Detrick, 4729 Fern Valley Rd., Medford, Oreg. 97504

[21] Appl. No.: 270,483

[22] Filed: Jul. 5, 1994

[51] Int. Cl.[6] ..... B65D 81/20

[52] U.S. Cl. ..... 206/524.8; 99/472; 215/229; 426/404

[58] Field of Search ..... 206/524.8; 99/472; 426/404; 215/229, 11.3; 220/705, 707, 708, 709; 383/33

[56] References Cited

U.S. PATENT DOCUMENTS

| | | | |
|---|---|---|---|
| 3,612,326 | 10/1971 | Marks | 215/40 |
| 3,656,668 | 4/1972 | Liebertz | 215/11.3 |
| 3,762,404 | 10/1973 | Sakita | 206/524.8 |
| 3,893,649 | 7/1975 | Cornell et al. | 383/33 |
| 3,943,987 | 3/1976 | Rossi | 150/5 |
| 3,980,226 | 9/1976 | Franz | 206/524.8 |
| 4,018,253 | 4/1977 | Kaufman | 206/524.8 |
| 4,093,009 | 6/1978 | Iavarone et al. | 206/524.8 |
| 4,165,814 | 8/1979 | Seel | 220/709 |
| 4,244,477 | 1/1981 | Seel | 220/709 |
| 4,362,095 | 12/1982 | Wheatley | 99/472 |
| 4,462,544 | 7/1984 | Rutzel et al. | 220/705 |
| 4,591,055 | 5/1986 | Corn | 206/459 |
| 5,009,318 | 4/1991 | Lepinoy | 206/524 |
| 5,080,155 | 1/1992 | Crozier | 206/524.8 |
| 5,271,240 | 12/1993 | Detrick | 62/268 |

FOREIGN PATENT DOCUMENTS

| | | | |
|---|---|---|---|
| 2421990 | 11/1975 | Germany | 220/705 |

*Primary Examiner*—Paul T. Sewell
*Assistant Examiner*—Marie Denise Patterson
*Attorney, Agent, or Firm*—Eugene M. Eckelman

[57] ABSTRACT

A container body portion with airtight defining walls and an open end is associated with a lid having airtight engagement with the open end. A tube projects through the lid in an airtight fit and communicates with the interior of the container. An outer open end of the tube is capable of connection to a source of vacuum. The lid has a sharpened projection that can be engaged by the end of the tube in a forced fit to provide a sealed atmosphere for the container. The container may be a body portion with self supporting airtight walls or it may comprise an airtight bag.

2 Claims, 1 Drawing Sheet

CONTAINER FOR HOLDING ARTICLES TO BE VACUUMED PACKED

BACKGROUND OF THE INVENTION

This invention relates to new and useful improvements in containers for holding articles to be vacuum packed.

It is known that vacuum packaging of perishable food articles substantially prolongs their storage life and minimizes spoilage. Vacuum packaging has heretofore been used for coffee such as shown in U.S. Pat. No. 4,362,095. U.S. Pat. Nos. 3,943,987 and 4,591,055 are also directed to containers for holding perishable articles in vacuum conditions. Further, vacuum packaging systems have been employed for conventional refrigeration and refrigeration-freezer units. Such a system is shown in my U.S. Pat. No. 5,271,240 which further shows vacuum receiving packages that can be used to enclose foodstuffs or the like to prolong them.

SUMMARY OF THE INVENTION

A primary object of the present invention is to provide vacuum receiving packages for foodstuffs and the like that have substantial improvements over the structures shown in my U.S. Pat. No. 5,271,240.

More particular objects are to provide packages of the type described that are convenient in use to receive articles to be vacuum packed, that employ novel vacuum sealing means, that employ a vacuum inlet tube and sealing means therefor that are disposed in an out-of-the-way protected manner and also allow end flush abutment of adjacent containers, that can be readily cleaned and reused and that provides ease of engagement with vacuum means.

In carrying out these objects, a first form of the container has a body portion with airtight defining walls and an open end. A lid is removably associated with this open end in an airtight engagement. An evacuating tube projects through said lid in an airtight fit with an inner end communicating with the interior of the container and an outer open end for connection to a source of vacuum. The lid includes sealing means engageable with the outer open end of the tube for closing the tube and maintaining a vacuum condition within the container. The sealing means comprises a sharpened projection on the lid which has a releasable sealed forced fit within the outer open end of said tube. The lid has a recess that provides countersunk protection of the tube and sealing projection below the top of the container lid surface. The container may comprise a self-supporting airtight wall type structure or a plastic bag.

The invention will be better understood and additional objects and advantages will become apparent from the following description taken in connection with the accompanying drawings.

DETAILED DESCRIPTION OF PREFERRED EMBODIMENTS

Figure 1:
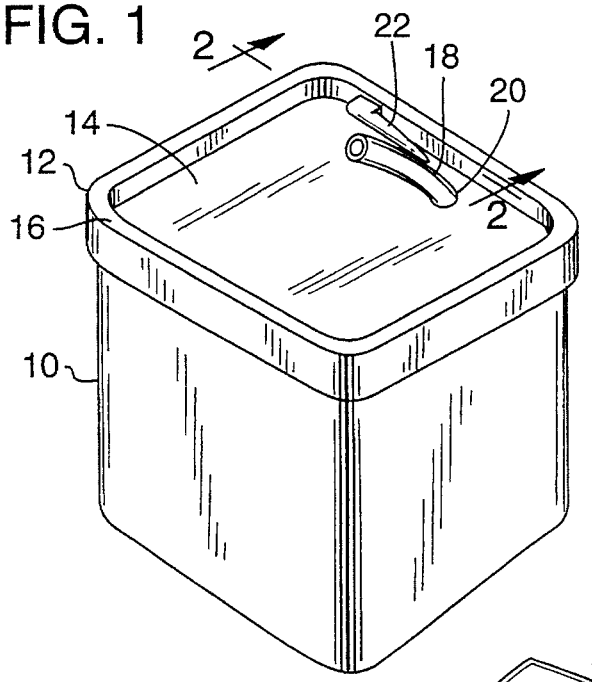
FIG. 1 is a perspective view of a first form of container for holding articles to be vacuum packed.
Figure 2:
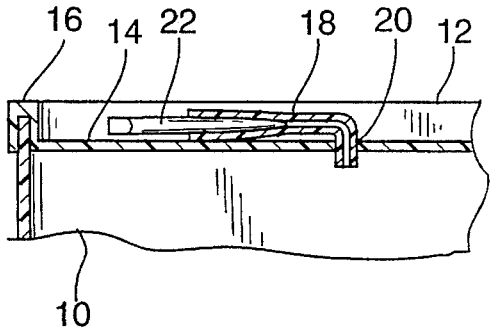
FIG. 2 is an enlarged fragmentary sectional view taken on the line 2—2 of FIG. 1.

Referring first to the embodiment of FIGS. 1 and 2, a first form of vacuum packaging structure is shown that provides convenience in preserving small amounts of food to prolong their storage life and minimize spoilage, such as leftovers and small packages. This first embodiment comprises a container 10 having self supporting airtight walls in a common form of refrigerator container.

According to the invention, the container receives an airtight lid 12 with a top recess 14 defined by a peripheral reinforcing flange 16. The lid, within the recess, has an integral flexible tube 18 with one end 20 sealed in the lid and communicating with the interior of the container.

The tube 18 is arranged to be connected to a source of vacuum to evacuate the air from the interior of the container and then sealed to maintain the vacuum environment that has been provided. Sealing of the tube is accomplished by plugging it onto a sharpened prong 22 that is molded or otherwise affixed to the inner defining wall of the flange 16 adjacent to and facing the exit point of the tube in the lid. The projecting length of the tube 20 is preselected such that the outer open end thereof can be forced onto the prong 22 as shown in FIG. 2 to provide the sealing mentioned.

The sharpened projection 22 is disposed below the top surface of the lid and the projecting length of the tube is such that when forced onto the projection 22, it will not buckle but instead will lie flat so as to be in a plane below the top surface of the lid. This sealing connection is thus protected from handling of the container and also will allow containers to be stacked on top of each other.

Figure 3:
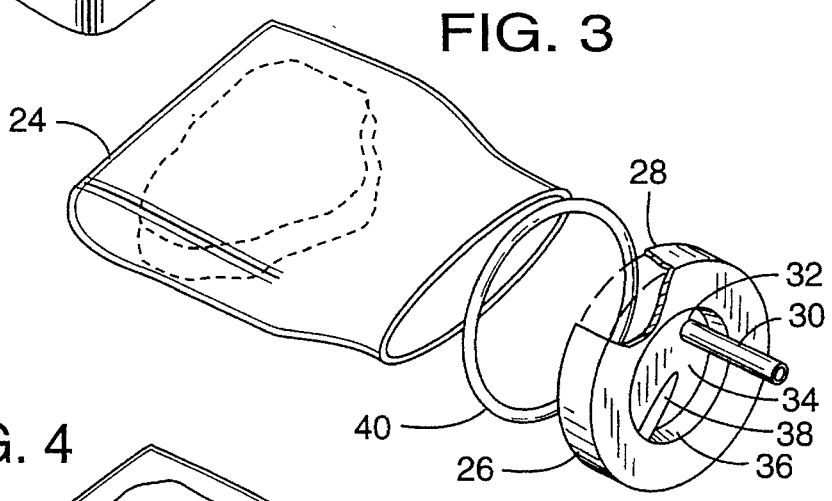
FIG. 3 is an exploded perspective view of a second embodiment of the invention.
Figure 4:
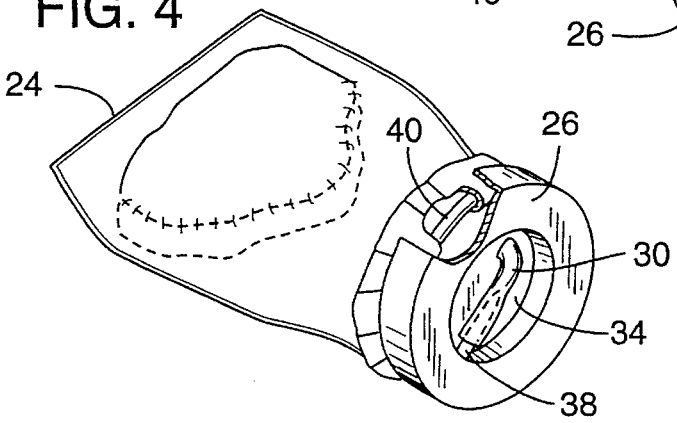
FIG. 4 is a perspective view of this second embodiment in sealed form.

FIGS. 3 and 4, show the invention applied to another vacuum packaging form, namely, plastic bags 24. In this form of the invention, a closure wall or lid 26 has an inturned edge flange 28 and an integral flexible tube 30 with one end 32 sealed in the lid that communicates with the interior of the bag. The outer surface of the lid has a recess 34 and the defining wall 36 of the recess has a sharpened projection 38 integral therewith that extends radially toward the tube 30. A sealing connection is made similar to the FIG. 1 embodiment wherein the tube is forced onto the sharpened prong 38 for sealing engagement. In this embodiment also, the tube 30 and the projection 38 are disposed within the recess 34 and when in sealing engagement they are disposed below the outer surface of the lid.

Associated with lid 26 is a ring 40 of an outer diameter capable of tight fitted engagement against the inner surface of the flange 28.

In mounting the lid on the bag, the open end of the bag is inserted through the ring and doubled back a short distance. The ring is then forced into engagement with the closure wall 28 with the bag end pinched between the ring and the closure wall, FIG. 4. The bag is then subjected to vacuum through the tube 30 wherein the tube is then sealed by forcing it onto the prong 38.

A convenient system for vacuum packaging according to the concept of the invention, comprises a vacuum pump combined with a refrigerator-freezer unit as shown in my U.S. Pat. No. 5,271,240.

According to the present packaging invention, the tubes 18 and 30 of the embodiments have the advantage that they are of sufficient length to make it convenient for attachment thereof to a vacuum nozzle. Vacuum sealing of these containers is fast and easy. Also, the structure is simple and inexpensive to manufacture. The containers have a wide opening for easy insertion and removal of articles and are readily sealed by lids with the vacuum sealing means recessed so as to be out of the way to provide flush abutment and stacking. The exposed vacuum means is readily cleaned, such as in a dish washer, for reuse of the container.

It is to be understood that the forms of my invention wherein shown and described are to be taken as preferred examples of the same and that various changes in the shape, size and arrangement of parts may be resorted to without departing from the spirit of my invention, or the scope of the subjoined claims.

Having thus described my invention, I claim:

1. A container for holding articles to be vacuum packed comprising a body portion with airtight defining walls and an open end, a lid removably mounted on said open end for closing said open end in an airtight relation when installed on said open end, said lid having an outer defining edge, an inner surface and an outer surface with a recess within the outer defining edge of said lid, a flexible tube having opposite ends, one end of said tube extending in an airtight fit through said lid within said recessed portion and having an inner open end communicating with the interior of said container closely adjacent said inner surface of said lid, said tube having an outer open end connectable to a source of vacuum, and a projection integral with said lid within said recessed portion, said projection having a size for releasable sealed forced insertion into the outer open end of said tube, said tube being disposed adjacent said projection and bendable for insertion of its outer open end in said forced fit on said projection wherein said tube when sealed on said projection is held down flat in said recess below the said outer end surface of said lid.

2. The container of claim 1 wherein said projection is sharpened to assist insertion thereof into the outer open end of said tube.

* * * * *